US008797243B2

(12) United States Patent
Min et al.

(10) Patent No.: US 8,797,243 B2
(45) Date of Patent: Aug. 5, 2014

(54) METHOD OF DRIVING LIQUID CRYSTAL DISPLAY DEVICE

(75) Inventors: Woong-Ki Min, Daegu (KR); Hong-Sung Song, Gyeongsangbuk-Do (KR)

(73) Assignee: LG Display Co. Ltd., Seoul (KR)

( * ) Notice: Subject to any disclaimer, the term of this patent is extended or adjusted under 35 U.S.C. 154(b) by 867 days.

(21) Appl. No.: 11/904,936

(22) Filed: Sep. 26, 2007

(65) Prior Publication Data

US 2008/0088556 A1 Apr. 17, 2008

(30) Foreign Application Priority Data

Oct. 16, 2006 (KR) ..... 10-2006-0100362

(51) Int. Cl.
*G09G 3/36* (2006.01)
*G09G 5/34* (2006.01)

(52) U.S. Cl.
CPC ..... *G09G 3/3614* (2013.01); *G09G 2320/10* (2013.01); *G09G 2320/0204* (2013.01); *G09G 2320/0257* (2013.01); *G09G 5/34* (2013.01)
USPC ..... 345/87; 345/96; 345/98; 345/100

(58) Field of Classification Search
None
See application file for complete search history.

(56) References Cited

U.S. PATENT DOCUMENTS

2003/0193459 A1* 10/2003 Kim et al. ..... 345/87
2004/0085283 A1* 5/2004 Wang ..... 345/100
2005/0285837 A1* 12/2005 Akimoto ..... 345/96
2006/0274075 A1* 12/2006 Yamazaki et al. ..... 345/543

FOREIGN PATENT DOCUMENTS

JP 05-035216 2/1993
JP 2000-122620 4/2000
JP 2001-209349 8/2001

OTHER PUBLICATIONS

Office Action issued in corresponding Japanese Patent Application No. 2007-259083, mailed Nov. 9, 2010.

* cited by examiner

*Primary Examiner* — Jesus Hernandez
(74) *Attorney, Agent, or Firm* — Brinks Gilson & Lione

(57) ABSTRACT

A method of driving a liquid crystal display device includes supplying data voltages to a pixel on a moving path of an image during a scroll operation, wherein the data voltages displaying the image have opposite polarities.

13 Claims, 5 Drawing Sheets

| frame No. | pixel voltage | pixel polarity |
|---|---|---|
| | | one-dot |
| 1 | Gray | + |
| 2 | Gray | - |
| 3 | Gray | + |
| 4 | Gray | - |
| 5 | Gray | + |
| 6 | Gray | - |
| 7 | Gray | + |
| 8 | White | - |
| 9 | Gray | - |
| 10 | Gray | + |
| 11 | Gray | - |
| 12 | Gray | + |
| 13 | Gray | - |
| 14 | Gray | + |
| 15 | Gray | - |
| 16 | White | + |
| 17 | Gray | + |
| 18 | Gray | - |
| 19 | Gray | + |
| 20 | Gray | - |
| 21 | Gray | + |
| 22 | Gray | - |
| 23 | Gray | + |
| 24 | White | - |
| 25 | Gray | - |
| 26 | Gray | + |
| 27 | Gray | - |
| 28 | Gray | + |
| 29 | Gray | - |
| 30 | Gray | + |
| 31 | Gray | - |
| 32 | White | + |
| 33 | Gray | + |
| 34 | Gray | - |
| 35 | Gray | + |

FIG. 4
RELATED ART

| frame No. | pixel voltage | pixel polarity | | |
|---|---|---|---|---|
| | | one-dot | first two-dot | second two-dot |
| 1 | Gray | + | + | + |
| 2 | Gray | - | + | - |
| 3 | Gray | + | - | - |
| 4 | Gray | - | - | + |
| 5 | Gray | + | + | + |
| 6 | Gray | - | + | - |
| 7 | Gray | + | - | - |
| 8 | White | - | - | + |
| 9 | Gray | + | + | + |
| 10 | Gray | - | + | - |
| 11 | Gray | + | - | - |
| 12 | Gray | - | - | + |
| 13 | Gray | + | + | + |
| 14 | Gray | - | + | - |
| 15 | Gray | + | - | - |
| 16 | White | - | - | + |
| 17 | Gray | + | + | + |
| 18 | Gray | - | + | - |
| 19 | Gray | + | - | - |
| 20 | Gray | - | - | + |
| 21 | Gray | + | + | + |
| 22 | Gray | - | + | - |
| 23 | Gray | + | - | - |
| 24 | White | - | - | + |
| 25 | Gray | + | + | + |
| 26 | Gray | - | + | - |
| 27 | Gray | + | - | - |
| 28 | Gray | - | - | + |
| 29 | Gray | + | + | + |
| 30 | Gray | - | + | - |
| 31 | Gray | + | - | - |
| 32 | White | - | - | + |
| 33 | Gray | + | + | + |
| 34 | Gray | - | + | - |
| 35 | Gray | + | - | - |

FIG. 5

| frame No. | pixel voltage | pixel polarity |
|---|---|---|
| | | one-dot |
| 1 | Gray | + |
| 2 | Gray | - |
| 3 | Gray | + |
| 4 | Gray | - |
| 5 | Gray | + |
| 6 | Gray | - |
| 7 | Gray | + |
| 8 | White | - |
| 9 | Gray | - |
| 10 | Gray | + |
| 11 | Gray | - |
| 12 | Gray | + |
| 13 | Gray | - |
| 14 | Gray | + |
| 15 | Gray | - |
| 16 | White | + |
| 17 | Gray | + |
| 18 | Gray | - |
| 19 | Gray | + |
| 20 | Gray | - |
| 21 | Gray | + |
| 22 | Gray | - |
| 23 | Gray | + |
| 24 | White | - |
| 25 | Gray | - |
| 26 | Gray | + |
| 27 | Gray | - |
| 28 | Gray | + |
| 29 | Gray | - |
| 30 | Gray | + |
| 31 | Gray | - |
| 32 | White | + |
| 33 | Gray | + |
| 34 | Gray | - |
| 35 | Gray | + |

METHOD OF DRIVING LIQUID CRYSTAL DISPLAY DEVICE

PRIORITY CLAIM

This application claims the benefit of priority from Korean Patent Application No. 2006-0100362, filed on Oct. 16, 2006, which is incorporated by reference.

BACKGROUND

1. Technical Field

The present invention relates to a liquid crystal display device, and in particular, to a method of driving a liquid crystal display device.

2. Related Art

Some display devices use cathode-ray tubes (CRTs). Other display devices may be flat panel displays, such as liquid crystal display (LCD) devices, plasma display panels (PDPs), field emission displays (FED), and electro-luminescence displays (ELDs). Some of these flat panel displays may be driven by an active matrix driving method in which a plurality of pixels arranged in a matrix configuration are driven using a plurality of thin film transistors. Among these active matrix type flat panel displays, liquid crystal display (LCD) devices and electroluminescent display (ELD) devices may exhibits a higher resolution, and increased ability to display colors and moving images as compared to some of the other flat panel display devices.

A LCD device may include two substrates that are spaced apart and face each other with a layer of liquid crystal molecules interposed between the two substrates. The two substrates may include electrodes that face each other. A voltage applied between the electrodes may induce an electric field across the layer of liquid crystal molecules. The alignment of the liquid crystal molecules may be changed based on an intensity of the induced electric field, thereby changing the light transmissivity of the LCD device. Thus, the LCD device may display images by varying the intensity of the electric field across the layer of liquid crystal molecules.

FIG. 1 is a block diagram of a LCD device according to the related art, and FIG. 2 is a circuit diagram of a liquid crystal panel of FIG. 1.

Referring to FIGS. 1 and 2, the LCD device includes a liquid crystal panel 2 and a driving circuit 26. The driving circuit 26 may include gate and data drivers 20 and 18, a timing controller 12, a gamma reference voltage generator 16, an interface 10 and a power generator 14.

Referring to FIG. 2, the liquid crystal panel 2 includes a plurality of pixels. The plurality of pixels are connected to a plurality of gate lines GL1 to GLn along a first direction and a plurality of data lines DL1 to DLm along a second direction. Each pixel includes a thin film transistor TFT and a liquid crystal capacitor LC. The liquid crystal capacitor LC includes a pixel electrode connected to the thin film transistor TFT, a common electrode, and a liquid crystal layer between the pixel and common electrodes. The common electrode is supplied with a common voltage.

The interface 10 is supplied with data signals and control signals such as a vertical synchronization signal, a horizontal synchronization signal, a data enable signal, and a data clock signal. The data signals and control signals are supplied from an external system, such as a computer system.

The timing controller 12 is supplied with the control signals from the interface 10 and generates control signals to control the gate and data drivers 20 and 18. The timing controller 12 processes data signals and supplies those to the data driver 18. The gate driver 20 is supplied with the control signals from the timing controller 12 to sequentially output gate voltages to the gate lines GL1 to GLn. The gate lines GL1 to GLn are sequentially enabled, and the thin film transistors TFT connected to the enabled gate line GL1 to GLn are turned on. The data driver 18 is supplied with the data signals and the control signals from the timing controller 12. The data driver 18 outputs data voltages to the data lines DL1 to DLm when the gate line GL1 to GLn is enabled. A gamma reference voltage generator 16 generates gamma reference voltages which are supplied to the data driver 18. The power generator 14 supplies voltages that operate the components of the LCD device.

An inversion method may be used to operate the LCD device. In the inversion method, the data voltages alternately have opposite polarities every predetermined pixel and every predetermined frame. Accordingly, deterioration of liquid crystal molecules is prevented.

For the LCD device operated in the inversion method, when a static image is scrolled, an after-image may occur along a moving path. This is referred to as a scroll after-image.

FIG. 3 is a view illustrating a scroll after-image in the LCD device according to the related art.

Referring to FIG. 3, when a static image shown with a solid line moves right to left in a liquid crystal screen 50, a scroll after-image shown with a dashed line appears along a moving path according to the scroll. This problem is caused by a DC voltage accumulation in the pixels along the moving path. In other words, the pixel on the moving path is repeatedly supplied with data voltages having the same polarity, and thus a DC voltage of such the polarity is accumulated in the pixel.

FIG. 4 is a table of data voltage polarities causing a DC voltage accumulation when a static image is scrolled with a predetermined scroll pattern in an LCD device according to the related art.

Referring to FIG. 4, a static image is white, and a background of the static image is gray. The predetermined is that when the static image is scrolled, the static image moves in a speed of N pixel/frame, for example, 8 pixel/frame and a white data voltage is inputted to a pixel, which is located on a moving path, every M frames according to the speed, for example, 8 frames.

In the related art, each pixel has positive and negative polarities alternately every frame according to a one-dot inversion method. Each pixel has positive and negative polarities alternately every two frames according to a first two-dot inversion method and a second two-dot inversion method.

Accordingly, when the scroll operation is conducted with the above inversion methods, the white data voltages having the same polarity, for example, a negative (−) polarity continue to be inputted to the pixel every 8 frames. In other words, this input of the white data voltages having the same polarity with a specific number of frames occurs commonly in the one-dot inversion method and the first and second two-dot inversion methods. Accordingly, a DC component of the same polarity is gradually accumulated in the pixel as the scroll operation continues, and this causes an after-image due to the scroll operation. In particular, as the speed gets lower, the static image stays at the pixel for a longer time and input frequency of the white data voltage having the same polarity increases. Accordingly, the DC voltage accumulation increases, and thus the after-image appears more.

SUMMARY

Accordingly, the present invention is directed to a method of driving a liquid crystal display device that substantially obviates one or more of the problems due to limitations and disadvantages of the related art.

An advantage of the present invention is to provide a method of driving a liquid crystal display device that can improve display quality.

Additional features and advantages of the present invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, a method of driving a liquid crystal display device includes supplying data voltages to a pixel on a moving path of an image during a scroll operation, wherein the data voltages displaying the image have opposite polarities.

In another aspect, a method of driving a liquid crystal display device includes supplying first data voltages to a pixel on a moving path of an image during N frames of a scroll operation; and supplying second data voltages to the pixel during next N frames of the scroll operation, wherein the first data voltage of a last frame of the N frames and the second data voltage of a last frame of the next N frames display the image and have opposite polarities.

In another aspect, a method of driving a liquid crystal display device, comprising supplying data voltages to a pixel on a moving path of an image during a scroll operation, wherein the data voltages displaying the image have opposite polarities every N frames and N is even.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 4 is a table of data voltages causing a DC voltage accumulation when a static image is scrolled with a predetermined scroll pattern in an LCD device according to the related art;

FIG. 5 is a table of data voltages when a static image is scrolled with a predetermined scroll pattern in an LCD device according to an embodiment of the present invention.

DETAILED DESCRIPTION

Reference will now be made in detail to illustrated embodiments of the present invention, which are illustrated in the accompanying drawings.

FIG. 5 is a table of data voltages when a static image is scrolled with a predetermined scroll pattern in an LCD device according to an embodiment of the present invention.

Figure 1:
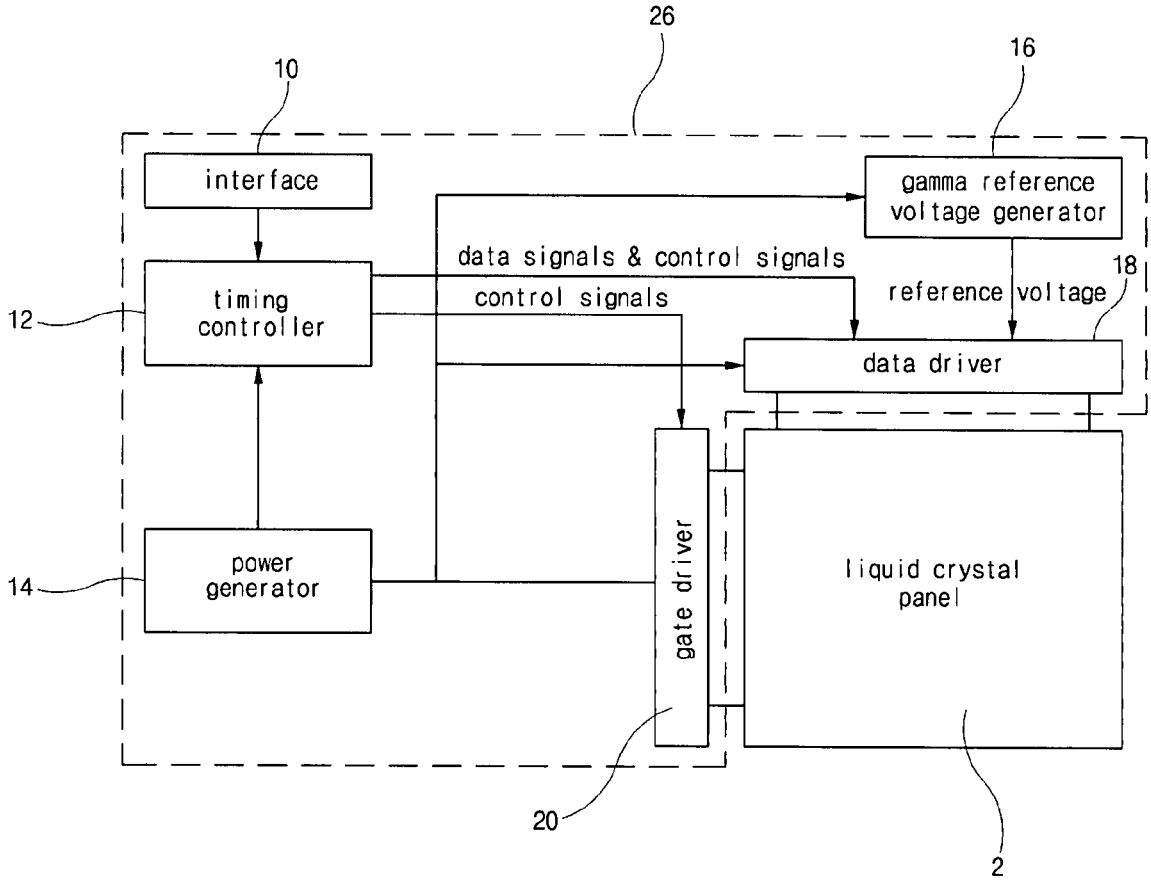
FIG. 1 RELATED ART
FIG. 1 is a block diagram of a LCD device according to the related art.
Figure 2:
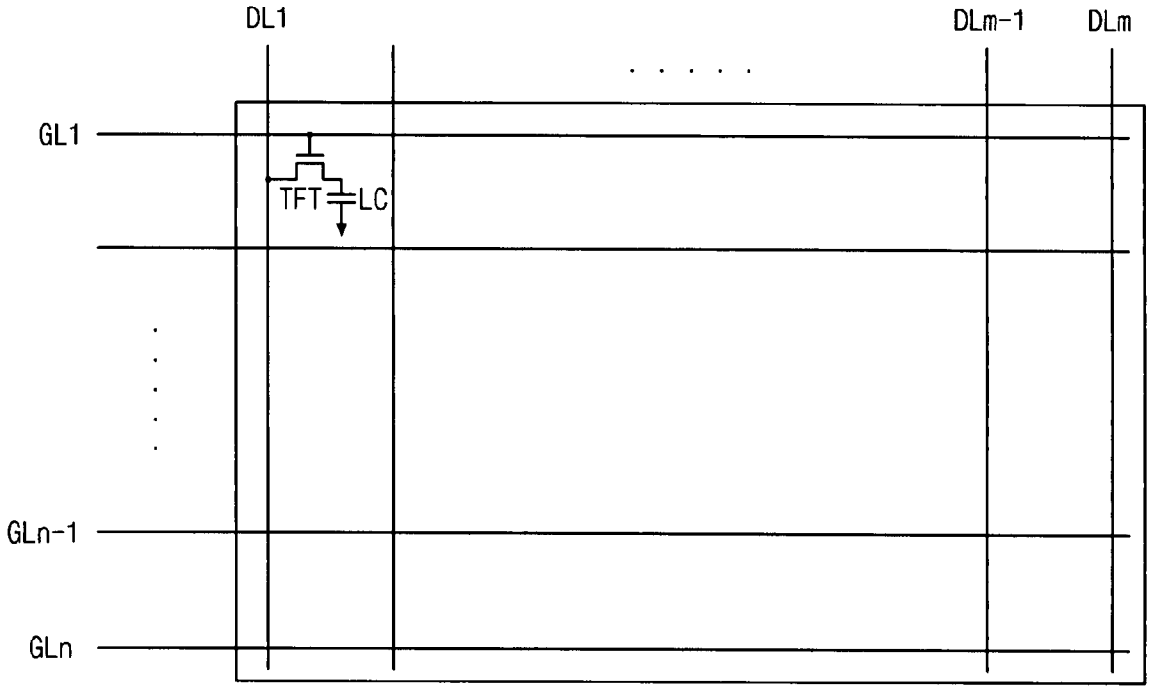
FIG. 2 RELATED ART
FIG. 2 is a circuit diagram of a liquid crystal panel of FIG. 1.
Figure 3:
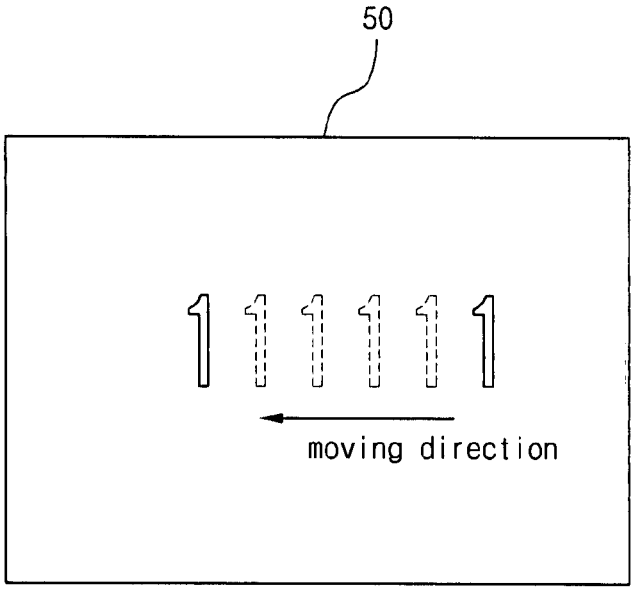
FIG. 3 RELATED ART
FIG. 3 is a view illustrating a scroll after-image in the LCD device according to the related art.

An LCD device according to the embodiment of the present invention is similar to the LCD device of FIGS. 1 and 2. Accordingly, explanations of parts similar to parts of FIGS. 1 and 2 will be omitted for brevity's sake.

Referring to FIG. 5, a static image is white, and a background of the static image is gray. The predetermined scroll pattern is that when the static image is scrolled, the static image moves in a speed of M pixel/frame, for example, 8 pixel/frame and a white data voltage is inputted to a pixel, which is located on a moving path, every N frames according to the speed, for example, 8 frames.

During a non-scroll operation, an inversion method, such as a one-dot inversion method and first and second two-dot inversion methods, is conducted in all frames of the non-scroll operation. During a scroll operation, all frames of the scroll operation may be divided in a plurality of time sections, and the inversion method may be conducted in each time section. The time section may be an input period of the white data voltage i.e., N frames. For example, when N is even, an inversion method in a time section may be opposite to an inversion method in a next time section, and thus polarity patterns of the pixel between adjacent time sections may be opposite. In other words, the pixel may have positive and negative polarities according to the inversion method in each time section, and the polarity patterns of data voltages may be opposite every time section. For example, when N is 8 and a one-dot inversion method is conducted, the LCD device is operated in the one-dot inversion method in each time section of 8 frames, and the polarity patterns of the data voltages are opposite every time section. Accordingly, the white data voltages having the opposite polarities are alternately inputted to the pixel every 8 frames. In other words, the white data voltages having a negative polarity are inputted at $8^{th}$, $24^{th}$, . . . frames, and the white data voltages having a positive polarity are inputted at $16^{th}$, $32^{nd}$, . . . frames. Accordingly, a DC component of the same polarity is not be accumulated in the pixel even as the predetermined scroll pattern continues, and thus an after-image due to the scroll operation can be prevented.

When N is odd, the LCD device may continue to be operated in the inversion method of the non-scroll operation without a change to the one-dot inversion method depending upon the time section.

Figure 6A:
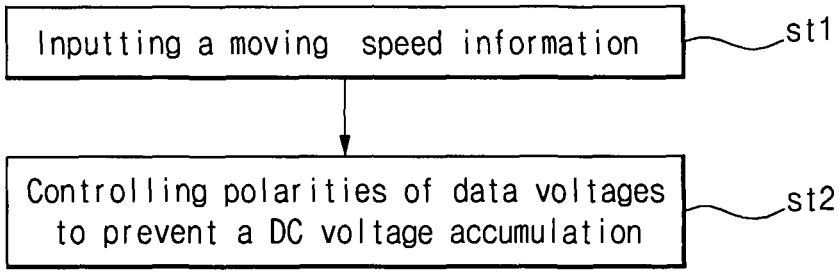
FIGS. 6A and 6B are flow charts illustrating a method of driving an LCD device according to the embodiment of the present invention.
Figure 6B:
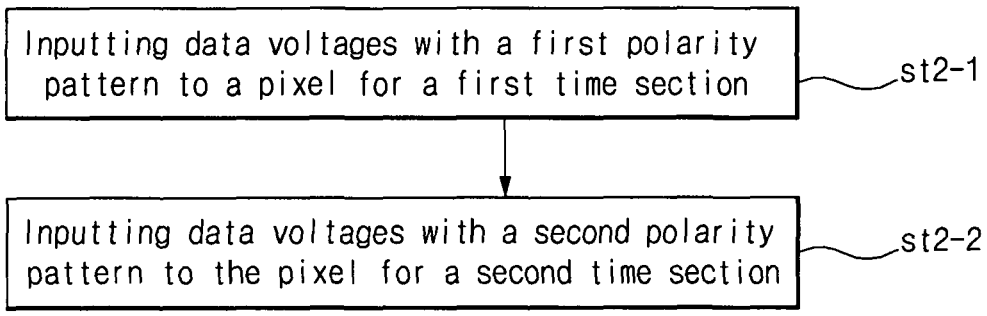

FIGS. 6A and 6B are flow charts illustrating a method of driving an LCD device according to the embodiment of the present invention.

Referring to FIG. 6A, in order that a scroll operation of a static image, for example, a white static image, is conducted in the LCD device of the embodiment, the LCD device is supplied with an information associated with a moving speed (pixel/frame) of the static image from an external system, for example, a computer or TV system (st1). The moving speed may be even.

The information associated with moving speed may be inputted to a timing controller. The timing controller may change an inversion method to control polarities of data voltages to prevent a DC voltage accumulation (st2).

In more detail, referring to FIG. 6B, the timing controller may set an input period of a white data voltage based on the moving speed. For example, the input period is N frames. The timing controller may change an inversion method of the LCD device according to the input period. For example, when an inversion method is operated before the scroll operation and N is even, the inversion method may be conducted separately in each time section. The time section may be the input period. For a first time section of 1 to Nth frames, data voltages with a first polarity pattern are inputted to a pixel on a moving path of a static image (st2-1). For a second time section of $(N+1)^{th}+2N^{th}$ frames, data voltages with a second polarity pattern which is opposite to the first polarity pattern (st2-2) are inputted to the pixel. For example, referring to FIG. 5 where N is 8 and a one-dot inversion method is conducted, positive (+) and negative (−) polarities are alternately inputted to the pixel for $1^{st}$ to $8^{th}$ frames, and negative (−) and positive (+) polarities are alternately inputted to the pixel for $9^{th}$ to $16^{th}$ frames. Accordingly, white data voltages having opposite polarities are alternately supplied to the pixel every N frames, and thus an after-image can be prevented.

As described above, in the embodiment, the data voltages displaying the static image do not have the same polarity but have opposite polarities during the scroll operation. Therefore, a DC voltage is not accumulated in the pixel on the moving path of the static image, and an after-image can be prevented.

The embodiment can be applicable to other inversion methods.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device, the method comprising:

receiving a moving speed of an image which is moved by a scroll operation along a path over a background;

determining a period of displaying the image based on the moving speed of the image moved by the scroll operation, wherein the period comprises an even number of frames having a last frame displaying the image preceded by a remaining background frames;

supplying data voltages to a pixel of the image which is moved by the scroll operation along the path over the background, wherein the data voltages of the pixel exhibit periodic opposite polarities based on the period when displaying the image; and wherein the liquid crystal display device includes a timing controller supplied with an information from an external system for detecting a moving speed of the scroll operation expressed in M pixel/frame by detecting movement of the image on the background, wherein M is an even number, wherein the external system is for supplying control signals including a vertical synchronization signal, a horizontal synchronization signal, a data enable signal and a data clock signal to the timing controller.

2. The method of claim 1, wherein the data voltages displaying the image are supplied every N frames and the period comprises N frames.

3. The method of claim 2, wherein the data voltages displaying the image alternate with an opposite polarity in every N frames.

4. The method of claim 3, wherein N is an even number.

5. The method of claim 3, wherein a first polarity pattern of the data voltages of first N frames is opposite to a second polarity pattern of the data voltages of next N frames.

6. The method of claim 5, wherein each of the first and the second polarity patterns immediately follows a same polarity of the last frame in a preceding N frames, and afterwards followed by an alternating pattern of opposite polarities for the remaining N frames.

7. A method of driving a liquid crystal display device, the method comprising:

receiving a moving speed of an image which is moved by a scroll operation along a path over a background;

determining a period of displaying the image based on the moving speed of the image moved by the scroll operation, wherein the period comprises N number of frames and wherein N is an even number;

supplying first data voltages to a pixel of the image which is moved along the path over the background during a first period of N frames of a scroll operation determined based on the moving speed; and supplying second data voltages to the pixel during a next period of N frames of the scroll operation determined based on the moving speed, wherein a first data voltage of a last frame of the first period of N frames and a second data voltage of a last frame of the next period of N frames display the image and have opposite polarities, and wherein the liquid crystal display device includes a timing controller supplied with an information from an external system for detecting the moving speed of the scroll operation expressed in M pixel/frame by detecting movement of the image on the background, wherein M is an even number, wherein the external system is for supplying control signals including a vertical synchronization signal, a horizontal synchronization signal, a data enable signal and a data clock signal to the timing controller.

8. The method of claim 7, wherein N is an even number.

9. The method of claim 7, wherein a first polarity pattern of the first data voltages is opposite to a second polarity pattern of the second data voltages.

10. The method of claim 9, wherein each of the first and the second polarity patterns are an alternating patterns in opposite polarities in at least every one frame.

11. A method of driving a liquid crystal display device, the method comprising:

receiving a moving speed of an image which is moved by a scroll operation along a path over a background;

determining a period of displaying the image based on the moving speed of the image moved by the scroll operation, wherein the period is of N number of frames and N is an even number;

supplying data voltages to a pixel of the image which is moved by the scroll operation along the path over the background, wherein the data voltages displaying the image have opposite polarities for each of the periods of the N frames and having a last frame of the N frames displaying the image preceded by a remaining background frames, and wherein the liquid crystal display device includes a timing controller supplied with an information from an external system for detecting the moving speed of the scroll operation expressed in M pixel/frame by detecting movement of the image on the background, wherein M is an even number, wherein the external system is for supplying control signals including a vertical synchronization signal, a horizontal synchronization signal, a data enable signal and a data clock signal to the timing controller.

12. The method of claim 11, wherein a first polarity pattern of the data voltages during first N frames is opposite to a second polarity pattern of the data voltages during next N frames.

13. The method of claim 12, wherein each of the first and the second polarity patterns is an alternating patterns in opposite polarities in at least every one frame.

* * * * *